US007691283B2

(12) United States Patent
Ohba et al.

(10) Patent No.: US 7,691,283 B2
(45) Date of Patent: Apr. 6, 2010

(54) SURFACTANT-BASED COMPOSITION

(75) Inventors: Yoshihiko Ohba, Hiratsuka (JP); Shinji Iwamoto, Hiratsuka (JP); Shota Mitsumune, Hiratsuka (JP); Masataka Kobayashi, Kitakyushu (JP); Hitoshi Tsuru, Chikushino (JP); Shuuichi Hatae, Kitakyushu (JP); Kazuya Uezu, Kitakyushu (JP); Keiichi Yamaga, Kitakyushu (JP); Yoshio Nagatomo, Kitakyushu (JP); Hisao Umeki, Kitakyushu (JP)

(73) Assignees: Furukawa Techno Materical Co., Ltd., Hiratsuka-shi (JP); Shabondama Soap Co., Ltd., Kitakyushu-shi (JP); Kitakyushu Foundation for the Advancement of Industry Science and Technology, Kitakyushu-shi (JP)

( * ) Notice: Subject to any disclaimer, the term of this patent is extended or adjusted under 35 U.S.C. 154(b) by 0 days.

(21) Appl. No.: 11/713,678

(22) Filed: Mar. 5, 2007

(65) Prior Publication Data

US 2007/0213248 A1 Sep. 13, 2007

Related U.S. Application Data

(63) Continuation of application No. PCT/JP2005/016682, filed on Sep. 5, 2005.

(30) Foreign Application Priority Data

Sep. 6, 2004 (JP) ..... 2004-258600
Mar. 3, 2005 (JP) ..... 2005-059553

(51) Int. Cl.
*A62D 1/04* (2006.01)
*B01F 17/00* (2006.01)
*C11D 1/00* (2006.01)

(52) U.S. Cl. ..... 252/3; 516/204

(58) Field of Classification Search ..... 516/204; 252/3

See application file for complete search history.

(56) References Cited

U.S. PATENT DOCUMENTS 4,306,979 A 12/1981 Tsuji
4,397,776 A 8/1983 Ward
4,704,233 A 11/1987 Hartman et al.
5,441,663 A 8/1995 Subramanyam et al.

FOREIGN PATENT DOCUMENTS

| | | | | |
|---|---|---|---|---|
| EP | 0070192 | A1 | | 1/1983 |
| EP | 1 797 926 | A1 | * | 6/2007 |
| GB | 474479 | A | | 11/1937 |
| GB | 2032273 | A | | 5/1980 |
| JP | 61-10026 | A | | 5/1986 |
| JP | A61-100266 | | | 5/1986 |
| JP | 10-46195 | A | | 2/1998 |
| JP | 11-188117 | A | | 7/1999 |
| JP | 2000-290699 | A | | 10/2000 |
| JP | 2001-279293 | A | | 10/2001 |
| JP | 2001-246012 | A | | 11/2001 |
| JP | 2002-129193 | A | * | 5/2002 |
| NL | 7407428 | A | | 1/1975 |

OTHER PUBLICATIONS

Machine English language translation of JP 2002-129193 A online @ http://www19.ipdl.inpit.go.jp/PA1/cgi-bin/PA1INDEX, JPO (Downloaded on Jun. 2008), pp. 9 of 9.*
Machine English language translation of JP 2001-279293 A online @ http://www19.ipdl.inpit.go.jp/PA1/cgi-bin/PA1INDEX, JPO (Downloaded on Jun. 2008), pp. 9 of 9.*
Supplemental European Search Report issued on Jan. 20, 2010 in corresponding European patent application No. EP-05778586.7.

* cited by examiner

*Primary Examiner*—Daniel S Metzmaier
(74) *Attorney, Agent, or Firm*—Birch, Stewart, Kolasch & Birch, LLP

(57) ABSTRACT

A water-addition-type surfactant-based composition, containing: at least one of a fatty acid sodium salt and/or potassium salt, as a surfactant component; and at least one of N,N-bis(carboxymethyl)-L-glutamic acid tetrasodium salt, L-aspartate-(N,N)-diacetic acid tetrasodium salt, N-2-hydroxyethyliminodiacetic acid disodium salt, (S,S)-ethylenediaminesuccinic acid trisodium salt, methylglycinediacetic acid trisodium salt, ethylenediaminetetraacetic acid, nitrilotriacetic acid, diethylenetriaminepentaacetic acid, hydroxyethylethylenediaminetriacetic acid, triethylenetetraminehexaacetic acid, 1,3-propanediaminetetraacetic acid, 1,3-diamino-2-hydroxypropanetetraacetic acid, dihydroxyethylglycine, glycol ether diamine tetraacetic acid, hydroxyethanediphosphonic acid, aminotrimethylenephosphonic acid, 1,2,4-butanetricarboxylic acid, dihydroxyethylethylenediaminediacetic acid, sodium gluconate, sodium glucoheptonate, inositol hexaphosphate, hydroxyethanoic acid, 2-hydroxypropanoic acid, 2-hydroxysuccinic acid, 2,3-dihydroxybutanedioic acid, and 2-hydroxy-1,2,3-propanetricarboxylic acid, as a chelating component.

9 Claims, No Drawings

SURFACTANT-BASED COMPOSITION

This application is a Continuation of copending PCT International Application No. PCT/JP2005/016682 filed on Sep. 5, 2005, which designated the United States, and on which priority is claimed under 35 U.S.C.§120. This application also claims priority under 35 U.S.C.§119(a) on Patent Application No(s). 2004-258600 and 2005-059553 filed in Japan on Sep. 6, 2004 and Mar. 3, 2005, respectively. The entire contents of each of the above documents are hereby incorporated by reference.

TECHNICAL FIELD

The present invention relates to a surfactant-based composition.

BACKGROUND ART

Soaps made from natural materials are solid, for washing applications, such as dish washing, face washing, or laundry, which are the primary purpose of soaps. In recent years, liquid washing agents (or liquid detergents) become to be used in widespread occasions, and typical ones are those containing a component as typified by LAS (linear alkylbenzene sulfonate), AOS (α-olefin sulfonate), or the like.

Load to the environment of the above synthetic surfactants has been indicated and discussed from various standpoints, and recently synthetic surfactants with excellent biodegradability have been developed. Commercially available synthetic shampoos or the like, which are safe for human body and organisms, are put to practical use, but they do not necessarily have no affection to the environment.

On the other hand, many houses in Japan are made of wood, and even in fire-proof buildings or the like, main structures in the buildings are generally made of combustible substances, such as paper, lumber, resin, or fiber. Further, large-scale fires, such as tire fires and forest fires, frequently break out in the current situation. Against these fires (generally referred to as 'A fire' or 'ordinary fire'), there is an increasingly demand for a water-addition-type fire extinguishing agent composition which assures prompt fire extinction with less amounts of water to discharge and disperse on fire and less consumption of chemical agents.

Examples of widely used conventional water-based fire extinguishing chemical agents include fortified solution-series, such as an aqueous solution of potassium carbonate or potassium hydrogencarbonate; and inorganic phosphate compound-series, such as ammonium phosphate.

On the other hand, it has been conventionally attempted to improve the fire extinguishing effect, recombustion (re-firing) prevention effect, and fire spread prevention effect of water-based fire extinguishing agents, by adding a surfactant, to decrease the surface tension of the agents, to increase the permeability thereof for lumber or the like, or to foam the agents to increase the adhesion property thereof. As foam fire-extinguishers widely used against ordinary fires, are known, for example, protein foam fire-extinguishers, synthetic surfactant foam fire-extinguishers, aqueous film-forming foam fire-extinguishers, or combinations of these foam fire-extinguishers and fluorine-containing surfactants.

Among those, most frequently used in Japan are surfactant-based fire extinguishing agents containing synthetic detergent components (hereinafter referred to as synthetic surfactant-based fire extinguishing agents).

These each are effective fire extinguishing agents, and achieve fire extinguishing far promptly and with less water consumption in comparison with fire extinguishing with water alone.

In a situation such as a forest fire in which a fire extinguishing agent is to be widely dispersed on the natural environment, water per se, which occurs in the natural world, will not decompose to form any toxic substances, or will not remain to affect the surrounding environment. On the other hand, like the detergents mentioned above, in some cases, there may be a possibility that fire extinguishing agents containing chemical synthetic substances may decompose to form toxic components, or that undecomposed residues of the fire extinguishing agents may remain for a long period of time to affect organisms in rivers or the sea, according to the components thereof.

Further, for the sake of improving the practicality as a fire extinguishing agent, antifreeze components such as ethylene glycol may be added to prevent coagulation in cold climate areas (for example, see JP-A-11-188117 ("JP-A" means unexamined published Japanese patent application)), but these are substances that the outflow thereof to the environment must be generally more cautioned than that of synthetic surfactants.

However, taking into consideration the following affections of fires continued over a long period of time on the natural environment, i.e. occurrence of a large volume of toxic combustion gases or outflow of contaminated water, or direct influences on organisms due to burning by forest fires, it is needless to say that, in many cases, even the fire extinguishing agents are added, the effects owing to achievement of fire extinction in a shorter period of time are rather more desirable, as compared to the above-mentioned affections. Therefore, fire extinguishing methods using fire extinguishing agents will be still required as before.

As described above, in future, in a composition, for example, a surfactant composition, which is applicable to a washing agent or fire extinguishing agent composed of a component(s) which imposes less load to the environment, it is increasingly required to select 100%-biodegradable components such as a soap, since they are less prone to affect the human body or natural environment.

DISCLOSURE OF INVENTION

Accordingly, an object of the present invention is to provide a surfactant-based composition which contains no synthetic surfactant component, and which imposes less load to the human body, organisms, and environment, and specifically to provide a surfactant-based composition which is applicable to a washing agent that leaves less soap residue or to a fire extinguishing agent that achieves high fire-extinguishing performance. Another object of the present invention is to provide a surfactant-based composition which is applicable to a washing agent that suffices with a less addition amount to water and less consumption amount after used, or to a water-addition-type fire extinguishing agent that has high fire-extinguishing and recombustion prevention effects, leaves less white soap residue after extinction, and has excellent eco-friendliness.

As a result of the eager investigation by the inventors of the present invention, the above-mentioned objects have been achieved with the means mentioned below wherein the composition is composed of vegetable fatty acid salt(s) and/or biodegradable component(s).

According to the present invention, there is provided the following means:

(1) A water-addition-type surfactant-based composition, comprising:

one, two, or more of a fatty acid sodium salt and/or potassium salt, as a surfactant component; and one, two, or more of N,N-bis(carboxymethyl)-L-glutamic acid tetrasodium salt (L-glutamate diacetic acid tetrasodium salt), L-aspartate-(N,N)-diacetic acid tetrasodium salt, N-2-hydroxyethyliminodiacetic acid disodium salt, (S,S)-ethylenediaminesuccinic acid trisodium salt, methylglycinediacetic acid trisodium salt, ethylenediaminetetraacetic acid, nitorilotriacetic acid, diethylenetriaminepentaacetic acid, hydroxyethylethylenediaminetriacetic acid, triethylenetetraminehexaacetic acid, 1,3-propanediaminetetraacetic acid, 1,3-diamino-2-hydroxypropanetetraacetic acid, dihydroxyethylglycine, glycol ether diamine tetraacetic acid, hydroxyethanediphosphonic acid, aminotrimethylenephosphonic acid, 1,2,4-butanetricarboxylic acid, dihydroxyethylethylenediaminediacetic acid, sodium gluconate, sodium glucoheptonate, inositol hexaphosphate, hydroxyethanoic acid, 2-hydroxypropanoic acid, 2-hydroxysuccinic acid, 2,3-dihydroxybutanedioic acid, and 2-hydroxy-1,2,3-propanetricarboxylic acid, as a chelating component;

(2) The water-addition-type surfactant-based composition according to the above item (1), which contains 8 to 50% by mass of the surfactant component and 1 to 50% by mass of the chelating component, with the remainder being water or a mixed solvent of water and one, two, or more of an alcohol and an ester;

(3) The water-addition-type surfactant-based composition according to the above item (2), wherein the mixed solvent contains 15 to 50% by mass of propylene glycol, relative to the whole amount of the composition;

(4) The water-addition-type surfactant-based composition according to the above item (3), wherein the mixed solvent contains 1 to 15% by mass of one, two, or more of isopropyl alcohol, normal propanol, normal butanol, octanol, 1,3-butylene glycol, hexylene glycol, sorbitol (D-glucitol), ethyl lactate, methyl glycolate, triethyl citrate, ethyl pyruvate, sodium lactate, and glycerol, relative to the whole amount of the composition, and 15 to 50% by mass of propylene glycol, relative to the whole amount of the composition;

(5) The water-addition-type surfactant-based composition according to any one of the above items (1) to (4), wherein the fatty acid sodium salt and/or potassium salt is a sodium salt and/or potassium salt of lauric acid, myristic acid, palmitic acid, stearic acid, oleic acid, or linolic acid;

(6) The water-addition-type surfactant-based composition according to the above item (5), wherein the fatty acid sodium salt or potassium salt contains 4 to 15% by mass of sodium oleate or potassium oleate, and 1 to 7% by mass of one, two, or more of potassium laurate, potassium myristate, potassium palmitate, and potassium stearate, and the total content thereof is 8 to 20% by mass;

(7) The water-addition-type surfactant-based composition according to any one of the above items (1) to (6), wherein the water-addition-type surfactant-based composition contains one, two, or more of sodium salicylate, sodium 3-hydroxybenzoate, sodium 4-hydroxybenzoate, and catechol, as a gelation inhibitory component;

(8) The water-addition-type surfactant-based composition according to any one of the above items (1) to (7), wherein the water-addition-type surfactant-based composition contains one, two, or more of gluconic acid, phytic acid, tartaric acid, malic acid, and lactic acid, as a pH controlling component;

(9) The water-addition-type surfactant-based composition according to any one of the above items (1) to (8), wherein the water-addition-type surfactant-based composition is a water-addition-type washing agent; and

(10) The water-addition-type surfactant-based composition according to any one of the above items (1) to (8), wherein the water-addition-type surfactant-based composition is a water-addition-type fire extinguishing agent.

Herein, the washing agent means one to be used for dish washing or the like, and the water-addition-type fire extinguishing agent means a fire extinguishing chemical agent for improving the fire extinguishing performance against fires by adding to and mixing with water to be discharged in an appropriate amount thereof, and for effectively achieving extinction with less amounts of water to discharge and disperse.

The vegetable fatty acid salt(s) contained in the composition of the present invention, such as sodium oleate, potassium laurate, or potassium myristate, is an eco-friendly component(s) which readily decomposes in the natural environment to revert to nature when used at low concentrations in a washing agent or fire extinguishing agent (2 to 3% by mass of the amount of water to discharge and disperse). The chelating agents, such as GLDA.4Na or ASDA, have biodegradability, and by adding any of these, it becomes possible to bind metal components in water to inhibit occurrence of soap residue. Further, water mixed with a solvent, such as propylene glycol (PG) or isopropyl alcohol (IPA), serves as a fire extinguishing agent which has a low pour point and is usable in cold climate areas. In particular, when n-butanol or octanol is added as the solvent, inhibition of gelation and raising up of the flash point can be achieved.

Further, by admixing thereto sodium salicylate or the like as the gelation inhibitory component, and gluconic acid or the like as the pH controlling component, the resultant composition becomes one that can be handled easily. From the above, there can be obtained a washing agent or fire extinguishing agent which imposes less load to the environment, and which achieves far higher fire extinguishing performance or has much better detergency, respectively, as compared to water alone. Other advantageous effects include that the foam removal is good with the composition (e.g. the composition has a favorable rinse speed), and that the composition eliminates the need of water-washing after cleaning or cleaning-up of foams after the completion of fire extinguishing works, which makes it easier to make an examination of the cause of fire or other tasks at the fire location.

Other and further features and advantages of the invention will appear more fully from the following description.

BEST MODE FOR CARRYING OUT THE INVENTION

The present invention is explained in detail below.

The water-addition-type surfactant-based composition of the present invention is one in which a surfactant and other component(s) are added to and mixed with water. When the composition is used as a washing agent, generally it is used after dilution with water or (luke)warm water to a concentration of preferably from 0.1% by mass to 1.0% by mass. When the composition is used as a fire extinguishing agent, it achieves very favorable fire extinguishing performance and provides a high level of safety during and after the use thereof when used at a mixing concentration between about 1% by mass and 3% by mass relative to the amount of water to discharge and disperse.

The surfactant-system of the present invention does not use a synthetic surfactant but uses a fatty acid salt, which is a natural surfactant, as the surfactant component. The fatty acid salt is a sodium salt or potassium salt of a vegetable fatty acid, such as lauric acid, myristic acid, palmitic acid, stearic acid, oleic acid, or linolic acid.

These fatty acid salts each may be used in the same manner. Typical examples thereof are described below in detail.

(A) Sodium Oleate [$CH_3(CH_2)_7CH{=}CH(CH_2)_7COONa$]

In an experiment for comparing a sodium soap and a potassium soap containing the same proportion of a fatty acid, it has been shown that the sodium soap has a stronger osmotic force than the potassium salt, but ordinary sodium soaps may fail to become liquid soaps but gelated or solidified. However, we found that a sodium soap of an unsaturated fatty acid, such as oleic acid or linolic acid, becomes liquid. Among them, it is preferable to use sodium oleate, because sodium oleate has good stability and has the second lowest surface tension following a lauric acid salt. The low surface tension increases permeability of water to contaminated matters, thus intrinsic detergency is exerted, and the permeability of moisture to combustible materials is increased during fire, which is effective for extinguishment at an early stage and prevention of recombustion.

(B) Potassium Laurate [$CH_3(CH_2)_{10}COOK$]

Potassium laurate has a high foaming power and generates a large amount of favorable roughish foams. The foams adhere to the surface of combustible materials during a fire to achieve a suffocation effect of preventing the supply of oxygen, which allows fire extinguishment at an early stage. It has high wettability due to its short alkyl group. Since sodium laurate tends to be solidified, the potassium salt is more preferable.

(C) Potassium Myristate [$CH_3(CH_2)_{12}COOK$]

Since potassium laurate alone produces rough foams which are poorly persistent, it is preferable to add potassium myristate to stabilize foams. However, too highly persistent foams has disadvantage that it is poor in foam removal property, which makes it not so easy to wash after cleaning or examine the cause of fire after extinction. Further, an aqueous solution of pH 9 to 10 is preferable because it produces fine and stable foams.

(D) Potassium Palmitate [$CH_3(CH_2)_{14}COOK$]

Potassium palmitate has a lower foaming power than potassium myristate, but is preferable because it produces stable and small foams.

These fatty acid salts may be used singly or in combination of two or more of them. The content thereof is preferably 8 to 50% by mass, and particularly preferably 12 to 20% by mass, relative to the entire composition. If the content is too low, detergency and fire extinguishing performance are poor, and if the content is excessive, gelation tends to occur.

When any of the above salts is/are used in combination, it is preferable that 4 to 15% by mass of sodium oleate or potassium oleate (% by mass relative to the whole amount of the composition, the same is applied hereinafter) and 1 to 7% by mass of any one, two, or more of potassium laurate, potassium myristate, potassium palmitate, and potassium stearate are added, and the total content of them is 8 to 20% by mass. The combination of them further improves the permeability of moisture to adherents or combustible materials, and improves foaming.

However, the composition of the present invention which contains natural fatty acid salt as the surfactant, may often form soap residue, due to the binding between metal components in water and the fatty acid salt as the soap component. The soap residue adheres to the surface once dried, and cannot be removed unless scraping with a brush or the like while flushing with water or hot water. If left untreated, they remains in white spots.

Such a state cannot be regarded as washed. In addition, if the composition is used as a fire extinguishing agent and water is discharged and dispersed against an actual building fire, it can prevent the spread of the fire, for example, when discharged to the wall or the like of a house adjacent to the burning building, but leaves white soap residue after extinction. Such a residue is quite hard to be cleaned particularly on a high-rise condominium or the like. Thus, it is often necessary to inhibit the occurrence of soap residue.

As mentioned above, for the sake of inhibiting occurrence of soap residue, the surfactant-based composition of the present invention contains one, two, or more chelating agent(s). The chelating component is preferably biodegradable, and preferable examples of the chelating agent include N,N-bis(carboxymethyl)-L-glutamic acid tetrasodium salt (GLDA.4Na), L-aspartate-(N,N)-diacetic acid tetrasodium salt (ASDA), N-2-hydroxyethyliminodiacetic acid disodium salt (HIDA), (S,S)-ethylenediaminesuccinic acid trisodium salt (EDDS), methylglycinediacetic acid trisodium salt (MGDA), ethylenediaminetetraacetic acid, nitorilotriacetic acid, diethylenetriaminepentaacetic acid, hydroxyethylethylenediaminetriacetic acid, triethylenetetraminehexaacetic acid, 1,3-propanediaminetetraacetic acid, 1,3-diamino-2-hydroxypropanetetraacetic acid, dihydroxyethylglycine, glycol ether diamine tetraacetic acid, hydroxyethanediphosphonic acid, aminotrimethylenephosphonic acid, 1,2,4-butanetricarboxylic acid, dihydroxyethylethylenediaminediacetic acid, sodium gluconate, sodium glucoheptonate, inositol hexaphosphate, hydroxyethanoic acid, 2-hydroxypropanoic acid, 2-hydroxysuccinic acid, 2,3-dihydroxybutanedioic acid, and 2-hydroxy-1,2,3-propanetricarboxylic acid.

The chelating component has the function that it captures metal components as hardness components in water, so as to prevent the loss of the soap component due to the occurrence of soap residue, and also to prevent the inhibitory effect of soap residue on foaming. As the chelating component, in particular, the above-mentioned N,N-bis(carboxymethyl)-L-glutamic acid tetrasodium salt (GLDA.4Na) and the like have better biodegradability than ethylenediaminetetraacetic acid (EDTA), and are highly compatible with various washing agent components and fire extinguishing agent components.

The occurrence of soap residue is inhibited when a chelating agent is added, this is due to that binding between metal components in water and the chelating component inhibits the occurrence of soap residue.

The content of the chelating component in the composition is preferably 1 to 50% by mass, and particularly preferably 20 to 50% by mass, relative to the entire composition. If the content is too low, not only soap residue occurs but also washing property (detergency) and fire extinguishing performance deteriorate. If the content is too high, the effect is not significantly enhanced.

With regard to the fire extinguishing performance, a mixed solution, which is prepared by mixing 0.5% by volume of a soap component and 0.5% by volume of a chelating agent, such as GLDA.4Na or ASDA, with 100 L of water, can achieve remarkably higher fire extinguishing performance in comparison with water.

However, mixing of a soap component with a chelating agent such as GLDA.4Na or ASDA has a disadvantage in that the mixing causes gelation even at ordinary temperature, and the resultant mixture cannot be used any more.

There is no problem in separately adding a soap component and a chelating agent such as GLDA.4Na or ASDA to water at the time of use, but the separate addition of a soap component and a chelating agent such as GLDA.4Na or ASDA needs a plurality of steps and is troublesome in actual laundry, face washing, or fire extinguishing, and it may be particularly difficult to respond to emergencies such as fire. Accordingly, it is preferable to add an additive for preventing gelation when a soap component is mixed with a chelating agent such as GLDA.4Na or ASDA to form a composition.

As mentioned above, it has been found, for resolving the phenomenon of gelation, which is a problem, it is preferable to add an alcohol or ester solvent, such as propylene glycol (hereinafter referred to as PG), isopropyl alcohol (hereinafter referred to as IPA), or normal butanol, to water that is a solvent. When the solvent is water alone, the liquid soap gelates at a soap content of about 20 to 30% by mass, but the addition of a solvent such as PG inhibits the gelation, and allows producing a highly concentrated liquid soap.

Examples of the solvent which may be added in the same manner as IPA include normal propanol, normal butanol, octanol, 1,3-butylene glycol, hexylene glycol (HG), sorbitol (D-glucitol), ethyl lactate, methyl glycolate, triethyl citrate, ethyl pyruvate, sodium lactate, and glycerol. These compounds are preferably used alone or in combination of two or more or them, and IPA is most preferable.

With regard to the proportion of the solvent, depending on the mixing ratio between the soap and the chelating agent, it is preferable to add PG in an amount of 15 to 50% by mass, more preferably 15 to 40% by mass, relative to the entire composition. In addition to PG, it is preferable to add another solvent such as IPA in an amount of 1 to 15% by mass, more preferably 3 to 15% by mass. If the addition amount of the alcohol or the like is too high, the flash point is low, and if too small, the effect by the addition of the solvent is not achieved.

However, the addition of such an organic solvent may lower the flash point of the resultant composition, which causes a problem that the composition is regarded as a hazardous material and the amount of stockpile thereof is limited by the law (the Fire Service Law of Japan), resultantly which makes the wholesale stockpile or storage thereof impossible. In this connection, normal butanol and octanol are preferable, since they each inhibit gelation and rise up the flash point.

When, to the above-mentioned surfactant component for use in the present invention to which water and an organic solvent has been added, a chelating component such as N,N-bis(carboxymethyl)-L-glutamic acid tetrasodium salt is added for the purpose of inhibiting occurrence of soap residue, the resultant mixture may be gelated and cannot be used. If the addition amounts of water and the organic solvent are increased in order to solve the above problem, the mixing concentration of the composition may be too high at the point of use, which is disadvantageous.

We analyzed the mechanism (structure) of the gel occurred upon the addition of the chelating component, and found that it has a lamellar structure. For the sake of inhibiting the gelation, it is preferable to add one, two, or more of chemical agent(s) having two hydrophilic groups in the benzene ring thereof, such as sodium salicylate, sodium 3-hydroxybenzoate, sodium 4-hydroxybenzoate, or catechol.

The composition containing these chemical agents is capable of reducing the amount of the solvent to be blended, and thus the mixing concentration (amount) thereof can be reduced when it is used as a washing agent or fire extinguishing agent.

The surfactant-based composition of this invention has a high pH value, and may have a pH value of about 13.0. Such a chemical agent is recalcitrant to users. The pH value can be decreased to about 9.0, by adding any one, two or more of pH controlling agents, such as gluconic acid, phytic acid, tartaric acid, malic acid, or lactic acid, to the composition.

In doing so, the composition becomes a product easy in handling thereof, when it is used as a washing agent or fire extinguishing agent.

Further, in the case where the surfactant-based composition is so corrosive to metals that it can deteriorate materials, equipment, fire engines, and the like, a metal corrosion inhibitor may be added thereto, to make the composition usable without anxiety.

PG also serves as an antifreeze, and the addition of PG significantly lowers the pour point, which allows the use of the fire extinguishing agent in cold climate areas. IPA has effects of accelerating the homogenization of a sodium soap and potassium soap, and improving the low temperature flowability, and prevents gelation upon the addition of a chelate. In addition, in the same manner as PG, the addition of IPA significantly lowers the pour point, and allows the use of the fire extinguishing agent in colder climate areas.

For example, a mixture of a soap, a chelating agent such as GLDA.4Na, and a solvent in a ratio of 1:1:1 does not cause gelation, even the resultant composition has a pour point of −17.5° C., even though a pour point is −17.5° C. That is, it is sufficiently adaptable to any weather conditions and any areas, taking the possible all the weather conditions in Japan into consideration. PG and IPA are the most preferable solvents for improving flowability.

The water-addition-type surfactant-based composition of the present invention has widespread applications as a washing agent, such as for dish washing, for facial cleansing, and for laundry, as well as for washing various instruments or equipments. As a liquid soap made from natural materials, the composition is quite convenient in practical aspects with inhibited occurrence of soap residue.

Further, when the water-addition-type surfactant-based composition is added as a fire extinguishing agent in an amount of 2 to 3% by mass to water to be discharged, it achieves high fire extinguishing performance against ordinary fires (e.g., house, lumber, or paper), forest fires, curtain fires (e.g., fiber), tire fires, automobile fires, rubber and plastic fires, industrial waste fires, and other fires.

Further, the water-addition-type surfactant-based composition may contain, if necessary, a foam stabilizing agent such as polyethylene glycol, a rust-preventive agent, an antioxidant, or the like. The composition has excellent preservation stability, and the washing property and fire extinguishing performance thereof will hardly deteriorate for about three years.

EXAMPLES

The present invention will be described in more detail based on examples given below.

The following are specific examples of the preparations in which the water-addition-type surfactant-based composition of the present invention is used as a fire extinguishing agent, and the following Tables 1 to 3 show the components, composition and properties of the compositions, but the invention is not meant to be limited to those examples.

The surfactant component was prepared as described below.

Preparation of Potassium Laurate or the Like (Bath A)

Propylene glycol (PG) and any one of solid fatty acids (lauric acid, myristic acid, or palmitic acid) were dissolved in a reaction bath by heating to 30 to 40° C. with a heater. After the completion of the dissolution, an aqueous potassium hydroxide solution (48% by mass of KOH) was slowly added to the reaction bath and allowed to react, while stirring. After the completion of the reaction, the reaction liquid was treated with an ion exchange resin, and purified water of hardness 5.0 ppm or lower was added to the reaction bath. Thus, potassium salts fatty acids (potassium laurate, potassium myristate, and potassium palmitate) were prepared.

Preparation of Sodium Oleate (Bath B)

Propylene glycol (PG) was placed in a reaction bath, and an aqueous sodium hydroxide solution (48% by mass of NaOH) was slowly added thereto, followed by stirring. Then, the reaction liquid was treated with an ion exchange resin, and purified water of hardness 5.0 ppm or lower was slowly added to the reaction bath. After confirming that the uniform mixing of the three components, PG, NaOH, and purified water, thereto oleic acid (liquid) was gradually added, to obtain sodium oleate.

A fire extinguishing agent 1 was prepared as follows.

20.6 g of potassium laurate and 13.5 g of potassium myristate, each of which had been prepared in the bath A, were mixed with 49.0 g of sodium oleate, which had been prepared in the bath B, in a container, and thereto 473.9 g of propylene glycol (PG) and 242.4 g of purified water were added. While stirring the resultant mixture, thereto 200 g of N,N-bis(carboxymethyl)-L-glutamic acid tetrasodium salt (GLDA.4Na) was gradually added, to obtain the fire extinguishing agent 1.

Portions of the thus-obtained fire extinguishing agent 1 were separately added to tap water, to prepare fire fighting water having concentrations from 0.3% to 2.5% as shown in Table 1, and each of the fire fighting water was subjected to the following performance tests. The pour point, long-term low temperature resistance, flammability, and pH were determined on the fire extinguishing agent per se.

Other fire extinguishing agents numbered 2 to 14 were prepared in the same manner as the fire extinguishing agent 1, and subjected to the performance test tests in the same manner as above. The results are shown in Tables 1 to 3.

In the tables, "composition" means the percentage by mass, and "concentration" means the concentration of an individual fire extinguishing agent when added to water.

The performance and other properties in the tables were determined and evaluated as described below.

"Fire extinguishing performance" was determined as follows: 82 pieces of lumbers (30 mm×35 mm×450 mm, water content 10 to 15%) were stacked up on a base in a tower form (5 pieces+5 pieces+4 pieces+4 pieces+5 pieces+5 pieces . . . +4 pieces+4 pieces+5 pieces+5 pieces), and 300 cc of normal heptane as a combustion aid was poured into an oil pan placed on the base. The combustion aid was ignited and burned for 2 minutes, then interrupted water discharging was performed with water discharged of a temperature 20±2° C. by repeated cycles of a discharging for 10 seconds (2.45 L/10-seconds) and halting for 50 seconds. "◎" indicates that the flame was extinguished within three times of discharging after the initiation of discharging, "○" indicates that the flame was finally extinguished without collapse of the tower, and "X" indicates that the flame was not distinguished and the tower lumber was collapsed due to the severe damage by burning.

"Pour point" was determined by examining the fire extinguishing agents in accordance with the "Testing methods for pour point of crude oil and petroleum products" as specified in JIS K2269.

"Long-term low temperature resistance" was determined by a method of measuring the period of time required for gelation, in a thermostat bath that was kept at −5° C. "○" indicates that no gelation occurred for 10 hours or longer, "Δ" indicates that gelation occurred in a time from 3 hours or longer to less than 10 hours, and "X" indicates that gelation occurred in less than 3 hours.

"Flash point" was determined in accordance with "Testing method for flash point of petroleum products" as specified in JIS K2265. "○" indicates that the flash point is 100° C. or higher, "Δ" indicates that 60° C. or higher and below 100° C., and "X" indicates that below 60° C.

"Foaming performance" was evaluated as follows: a mixed solution was charged in a 8-L foam extinguisher, and nitrogen gas was further added therein for pressurizing to achieve a pressure of about 0.85 MPa, and then foams were discharged into a foam collector. "○" indicates that a foaming power (or, a magnification of foams formed) of 8 times or more, "Δ" indicates that 5 times or more and less than 8 times, and "X" indicates that less than 5 times.

"Occurrence of residue" was evaluated as follows: solutions of the indicated concentrations were prepared, dispersed on concrete, and the occurrence of soap residue was observed in a dried state. "Occurred" indicates that adhesion of white soap residue was observed on the concrete with the naked eye, and "None" indicates that no adhesion of residue was observed.

TABLE 1

| Fire extinguishing agent | Composition | | Concentration | Fire extinguishing performance | Pour point | Long-term low temperature resistance | Flammability | Foaming performance | Occurrence of residues | pH |
|---|---|---|---|---|---|---|---|---|---|---|
| 1 | Sodium oleate | 4.90% | 0.3% | X | 2.5° C. | X | ○ | X | Occurred | 13.05 |
| | Potassium laurate | 2.06% | 0.5% | X | | | | X | Occurred | |
| | Potassium myristate | 1.35% | 1.0% | X | | | | X | Occurred | |
| | Potassium palmitate | — | 1.5% | X | | | | X | Occurred | |
| | PG | 47.39% | 2.5% | ◎ | | | | ○ | None | |
| | Purified water | 24.24% | | | | | | | | |
| | GLDA•4Na | 20.00% | | | | | | | | |
| | IPA | — | | | | | | | | |
| 2 | Sodium oleate | 8.41% | 0.5% | X | −10.0° C. | X | ○ | X | Occurred | 13.09 |
| | Potassium laurate | 5.66% | 1.0% | X | | | | X | Occurred | |
| | Potassium myristate | — | 1.5% | X | | | | ○ | None | |
| | Potassium palmitate | — | 2.5% | ○ | | | | ○ | None | |

TABLE 1-continued

| Fire extin-guishing agent | Composition | | Concen-tration | Fire extin-guishing performance | Pour point | Long-term low temperature resistance | Flam-mability | Foaming performance | Occur-rence of residues | pH |
|---|---|---|---|---|---|---|---|---|---|---|
| | PG | 34.47% | 3.0% | ◎ | | | | ○ | None | |
| | Purified water | 18.09% | | | | | | | | |
| | GLDA•4Na | 33.33% | | | | | | | | |
| | IPA | — | | | | | | | | |
| 3 | Sodium oleate | 8.16% | 0.5% | X | −17.5° C. | ○ | X | X | Occurred | 13.07 |
| | Potassium laurate | 4.58% | 1.0% | X | | | | X | Occurred | |
| | Potassium myristate | 0.98% | 1.5% | X | | | | ○ | None | |
| | Potassium palmitate | 0.138% | 2.0% | ○ | | | | ○ | None | |
| | PG | 32.37% | 2.5% | ◎ | | | | ○ | None | |
| | Purified water | 7.1% | 3.0% | ◎ | | | | ○ | None | |
| | GLDA•4Na | 33.33% | | | | | | | | |
| | IPA | 13.33% | | | | | | | | |
| 4 | Sodium oleate | — | 0.5% | X | −12.5° C. | X | ○ | X | Occurred | 13.08 |
| | Potassium laurate | 34.3% | 1.0% | X | | | | X | Occurred | |
| | Potassium myristate | 7.4% | 2.5% | ◎ | | | | Δ | Occurred | |
| | Potassium palmitate | 1.0% | 3.0% | ◎ | | | | ○ | Occurred | |
| | PG | 36.1% | | | | | | | | |
| | Purified water | 19.4% | | | | | | | | |
| | GLDA•4Na | 1.8% | | | | | | | | |
| | IPA | — | | | | | | | | |
| 5 | Sodium oleate | — | 0.5% | X | −17.5° C. | Δ | Δ | X | Occurred | 13.00 |
| | Potassium laurate | 34.3% | 1.0% | X | | | | X | Occurred | |
| | Potassium myristate | 7.4% | 1.5% | — | | | | Δ | Occurred | |
| | Potassium palmitate | 1.0% | 3.0% | ◎ | | | | ○ | Occurred | |
| | PG | 31.6% | | | | | | | | |
| | Purified water | 16.7% | | | | | | | | |
| | GLDA•4Na | 4.5% | | | | | | | | |
| | IPA | 4.5% | | | | | | | | |
| 6 (Comparative example) | Sodium oleate | — | 0.5% | X | −5.0° C. | X | ○ | X | Occurred | 13.09 |
| | Potassium laurate | 24% | 1.0% | — | | | | X | Occurred | |
| | Potassium myristate | 16% | 1.5% | X | | | | X | Occurred | |
| | Potassium palmitate | — | 2.0% | X | | | | Δ | Occurred | |
| | PG | 35% | 3.0% | X | | | | ○ | Occurred | |
| | Purified water | 25% | | | | | | | | |
| | GLDA•4Na | — | | | | | | | | |
| | IPA | — | | | | | | | | |

TABLE 2

| Fire extin-guishing agent | Composition | | Concen-tration | Fire extin-guishing performance | Pour point | Long-term low temperature resistance | Flam-mability | Foaming performance | Occur-rence of residues | pH |
|---|---|---|---|---|---|---|---|---|---|---|
| 7 | Sodium oleate | 9.80% | 0.5% | X | −12.5° C. | X | ○ | X | Occurred | 10.06 |
| | Potassium laurate | 6.75% | 1.0% | ○ | | | | ○ | None | |
| | Potassium myristate | — | 1.5% | ◎ | | | | ○ | None | |
| | Potassium palmitate | 0.1% | 2.0% | ◎ | | | | ○ | None | |
| | PG | 28.17% | 3.0% | ◎ | | | | ○ | None | |
| | Purified water | 9.77% | | | | | | | | |
| | GLDA•4Na | 37.5% | | | | | | | | |
| | IPA | — | | | | | | | | |
| | HG | 6.67% | | | | | | | | |
| | Gluconic acid | 1.25% | | | | | | | | |
| 8 | Sodium oleate | 9.72% | 0.5% | X | −12.5° C. | Δ | ○ | X | Occurred | 10.46 |
| | Potassium laurate | 6.69% | 1.0% | ○ | | | | ○ | None | |
| | Potassium myristate | — | 1.5% | ◎ | | | | ○ | None | |
| | Potassium palmitate | 0.1% | 2.0% | ◎ | | | | ○ | None | |
| | PG | 27.92% | 3.0% | ◎ | | | | ○ | None | |
| | Purified water | 9.69% | | | | | | | | |
| | GLDA•4Na | 37.2% | | | | | | | | |
| | IPA | — | | | | | | | | |
| | HG | 6.60% | | | | | | | | |
| | Gluconic acid | 1.24% | | | | | | | | |
| | Sodium salicylate | 0.83% | | | | | | | | |
| 9 | Sodium oleate | 9.80% | 0.5% | X | −20.0° C. | ○ | ○ | X | Occurred | 10.52 |
| | Potassium laurate | 6.75% | 1.0% | ○ | | | | ○ | None | |
| | Potassium myristate | — | 1.5% | ◎ | | | | ○ | None | |
| | Potassium palmitate | 0.1% | 2.0% | ◎ | | | | ○ | None | |
| | PG | 26.83% | 3.0% | ◎ | | | | ○ | None | |
| | Purified water | 9.77% | | | | | | | | |

TABLE 2-continued

| Fire extin-guishing agent | Composition | | Concen-tration | Fire extin-guishing performance | Pour point | Long-term low temperature resistance | Flam-mability | Foaming performance | Occur-rence of residues | pH |
|---|---|---|---|---|---|---|---|---|---|---|
| | GLDA•4Na | 37.5% | | | | | | | | |
| | IPA | — | | | | | | | | |
| | HG | 6.00% | | | | | | | | |
| | Gluconic acid | 1.25% | | | | | | | | |
| | n-Butanol | 2.00% | | | | | | | | |
| 10 | Sodium oleate | 9.80% | 0.5% | X | −27.5° C. | ○ | ○ | X | Occurred | 10.60 |
| | Potassium laurate | 6.75% | 1.0% | ○ | | | | ○ | None | |
| | Potassium myristate | — | 1.5% | ◎ | | | | ○ | None | |
| | Potassium palmitate | 0.1% | 2.0% | ◎ | | | | ○ | None | |
| | PG | 14.83% | 3.0% | ◎ | | | | ○ | None | |
| | Purified water | 23.77% | | | | | | | | |
| | GLDA•4Na | 37.5% | | | | | | | | |
| | IPA | — | | | | | | | | |
| | HG | 6.67% | | | | | | | | |
| | Gluconic acid | 1.25% | | | | | | | | |
| 11 | Sodium oleate | 9.72% | 0.5% | X | −35.0° C. | ○ | ○ | X | Occurred | 10.46 |
| | Potassium laurate | 6.69% | 1.0% | ○ | | | | ○ | None | |
| | Potassium myristate | — | 1.5% | ◎ | | | | ○ | None | |
| | Potassium palmitate | 0.1% | 2.0% | ◎ | | | | ○ | None | |
| | PG | 14.72% | 3.0% | ◎ | | | | ○ | None | |
| | Purified water | 23.52% | | | | | | | | |
| | GLDA•4Na | 37.2% | | | | | | | | |
| | IPA | — | | | | | | | | |
| | HG | 5.98% | | | | | | | | |
| | Gluconic acid | 1.24% | | | | | | | | |
| | Sodium salicylate | 0.83% | | | | | | | | |

TABLE 3

| Fire extin-guishing agent | Composition | | Concen-tration | Fire extin-guishing performance | Pour point | Long-term low temperature resistance | Flamm-ability | Foaming performance | Occur-ence of residues | pH |
|---|---|---|---|---|---|---|---|---|---|---|
| 12 | Sodium oleate | 9.80% | 0.5% | X | −35.0° C. | ○ | ○ | X | Occurred | 10.46 |
| | Potassium laurate | 6.75% | 1.0% | ○ | | | | ○ | None | |
| | Potassium myristate | — | 1.5% | ◎ | | | | ○ | None | |
| | Potassium palmitate | 0.1% | 2.0% | ◎ | | | | ○ | None | |
| | PG | 14.83% | 3.0% | ◎ | | | | ○ | None | |
| | Purified water | 22.27% | | | | | | | | |
| | GLDA•4Na | 37.5% | | | | | | | | |
| | IPA | — | | | | | | | | |
| | HG | 5.50% | | | | | | | | |
| | Gluconic acid | 1.25% | | | | | | | | |
| | n-Butanol | 2.00% | | | | | | | | |
| 13 | Sodium oleate | 9.80% | 0.5% | X | −35.0° C. | ○ | ○ | X | Occurred | 10.46 |
| | Potassium laurate | 6.75% | 1.0% | ○ | | | | ○ | None | |
| | Potassium myristate | — | 1.5% | ◎ | | | | ○ | None | |
| | Potassium palmitate | 0.1% | 2.0% | ◎ | | | | ○ | None | |
| | PG | 14.83% | 3.0% | ◎ | | | | ○ | None | |
| | Purified water | 22.27% | | | | | | | | |
| | Ethylenediamine-tetraacetic acid | 37.5% | | | | | | | | |
| | IPA | — | | | | | | | | |
| | HG | 5.50% | | | | | | | | |
| | Gluconic acid | 1.25% | | | | | | | | |
| | n-Butanol | 2.00% | | | | | | | | |
| 14 | Sodium oleate | 9.80% | 0.5% | X | −35.0° C. | ○ | ○ | X | Occurred | 10.46 |
| | Potassium laurate | 6.75% | 1.0% | ○ | | | | ○ | None | |
| | Potassium myristate | — | 1.5% | ◎ | | | | ○ | None | |
| | Potassium palmitate | 0.1% | 2.0% | ◎ | | | | ○ | None | |
| | PG | 14.83% | 3.0% | ◎ | | | | ○ | None | |
| | Purified water | 22.27% | | | | | | | | |
| | Nitorilotriacetic acid | 37.5% | | | | | | | | |
| | IPA | — | | | | | | | | |
| | HG | 5.50% | | | | | | | | |
| | Gluconic acid | 1.25% | | | | | | | | |
| | n-Butanol | 2.00% | | | | | | | | |

(Note)
"—" indicates not added or not tested

From the results in the above tables, the followings can be understood.

The fire extinguishing agent 1 showed an improved foaming power. Further, due to containing the chelating agent (GLDA.4Na), although the occurrence of soap residue was not completely inhibited at lower concentrations, no occurrence of soap residue was observed when used at a concentration of 2.5%, and it was excellent in the fire extinguishing performance. However, the pour point was not low, since the agent contained no IPA as a solvent.

The fire extinguishing agent 2 contained the chelating agent (GLDA.4Na) in an amount of ⅓ of the whole amount, thus the occurrence of soap residue was inhibited at a concentration of 1.5%. The agent was also excellent in the fire extinguishing performance and the foaming property.

The fire extinguishing agent 3 showed improved flowability, since it contained IPA (isopropyl alcohol) as a solvent in addition to the fire extinguishing agent 2. Further, since the agent contained palmitate and myristate, as well as oleate and laurate, it showed enhanced foaming power and achieved further improved fire extinguishing performance.

The fire extinguishing agents 4 and 5 contained the chelating component in a rather small amount, thus the occurrence of soap residue was not inhibited, but they were excellent in the fire extinguishing performance and other properties. The fire extinguishing agent 4 showed a rather high pour point because it contained no IPA. The fire extinguishing agent 5 showed improved flowability because it contained IPA.

The fire extinguishing agent 6 (Comparative Example) contained only two types of fatty acid salts and did not contain any chelating component, and is equivalent to a conventional example. This agent was poor in the fire extinguishing performance, and occurrence of soap residue was observed, even at concentrations of 2.0% or higher.

The fire extinguishing agents 7 to 12 contained HG (hexylene glycol) as a solvent, and their pH had been lowered by blending gluconic acid. They each had excellent fire extinguishing performance at concentrations of 1.0% or higher, and had a lowered pH.

The fire extinguishing agent 7 had a lowered pH of about 10. The fire extinguishing agent 8, which contained sodium salicylate for the inhibition of gelation and adjustment of pH, showed improved long-term low temperature resistance. The fire extinguishing agent 9, which contained n-butanol for the adjustment of pH and flash point, showed further improved long-term low temperature resistance.

The fire extinguishing agents 10 to 12 are examples, which gelated at lower temperatures due to the changed ratio between water and PG, and showed a particularly low pour point. The fire extinguishing agent 11 further contained sodium salicylate, and the fire extinguishing agent 12 further contained N-butanol, they each had a low pour point, and a further higher long-term low temperature resistance.

The fire extinguishing agents 13 and 14 were the examples using ethylenediaminetetraacetic acid (EDTA) or nitorilotriacetic acid, as the chelating, which was changed from GLDA.4Na in the fire extinguishing agent 12, and they each were excellent in the performances similar to those of the fire extinguishing agent 12.

INDUSTRIAL APPLICABILITY

The surfactant-based composition of the present invention can be used as a washing agent or water-addition-type fire extinguishing agent, which is high in safety.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A fire-extinguishing agent that is a water-addition-type surfactant-based composition, comprising:

at least one surfactant component selected from the group consisting of a fatty acid sodium salt and a fatty acid potassium salt, in an amount of 8 to 50% by mass;

at least one chelating component selected from the group consisting of N,N-bis(carboxymethyl)-L-glutamic acid tetrasodium salt, L-aspartate-(N,N)-diacetic acid tetrasodium salt, N-2-hydroxyethyliminodiacetic acid disodium salt, (S,S)-ethylenediaminesuccinic acid trisodium salt, methylglycinediacetic acid trisodium salt, ethylenediaminetetraacetic acid, nitorilotriacetic acid, diethylenetriaminepentaacetic acid, hydroxyethylethylenediaminetriacetic acid, triethylenetetraminehexaacetic acid, 1,3-propanediaminetetraacetic acid, 1,3-diamino-2-hydroxypropanetetraacetic acid, dihydroxyethylglycine, glycol ether diamine tetraacetic acid, hydroxyethanediphosphonic acid, aminotrimethylenephosphonic acid, 1,2,4-butanetricarboxylic acid, dihydroxyethylethylenediaminediacetic acid, sodium gluconate, sodium glucoheptonate, inositol hexaphosphate, hydroxyethanoic acid, 2-hydroxypropanoic acid, 2-hydroxysuccinic acid, 2,3-dihydroxybutanedioic acid, and 2-hydroxy-1,2,3-propanetricarboxylic acid, in an amount of 1 to 50% by mass; and a mixed solvent of water and at least one solvent selected from the group consisting of an alcohol and an ester, comprising 15 to 50% by mass of propylene glycol, relative to the whole amount of the composition;

wherein the sum total of the amounts of the surfactant component, the chelating component, and the mixed solvent including propylene glycol does not exceed 100% by mass, and wherein said composition is suitable for use as a fire-extinguishing agent.

2. The fire-extinguishing agent according to claim 1, wherein the mixed solvent contains 1 to 15% by mass of one, two, or more of isopropyl alcohol, normal propanol, normal butanol, octanol, 1,3-butylene glycol, hexylene glycol, sorbitol (D-glucitol), ethyl lactate, methyl glycolate, triethyl citrate, ethyl pyruvate, sodium lactate, and glycerol, relative to the whole amount of the composition, and 15 to 50% by mass of propylene glycol, relative to the whole amount of the composition.

3. The fire-extinguishing agent according to claim 1, wherein the fatty acid sodium salt and/or potassium salt is a sodium salt and/or potassium salt of lauric acid, myristic acid, palmitic acid, stearic acid, oleic acid, or linolic acid.

4. The fire-extinguishing agent according to claim 3, wherein the fatty acid sodium salt or potassium salt contains 4 to 15% by mass of sodium oleate or potassium oleate, and 1 to 7% by mass of one, two, or more of potassium laurate, potassium myristate, potassium palmitate, and potassium stearate, and the total fatty acid salt content is 8 to 20% by mass relative to the whole amount of the composition.

5. The fire-extinguishing agent according to claim 1, wherein the water-addition-type surfactant-based composition contains one, two, or more of sodium salicylate, sodium 3-hydroxybenzoate, sodium 4-hydroxybenzoate, and catechol, as a gelation inhibitory component.

6. The fire-extinguishing agent according to claim 1, wherein the water-addition-type surfactant-based composition contains one, two, or more of gluconic acid, phytic acid, tartaric acid, malic acid, and lactic acid, as a pH controlling component.

7. The fire-extinguishing agent according to claim 1, wherein said composition does not contain a synthetic surfactant.

8. The fire-extinguishing agent according to claim 7, wherein said synthetic surfactant is linear alkylbenzene sulfonate (LAS) or x-olefin sulfonate (AOS).

9. A fire-extinguishing agent that is a water-addition-type surfactant-based composition, consisting essentially of:

at least one surfactant component selected from the group consisting of a fatty acid sodium salt and a fatty acid potassium salt, in an amount of 8 to 50% by mass;

at least one chelating component selected from the group consisting of N,N-bis(carboxymethyl)-L-glutamic acid tetrasodium salt, L-aspartate-(N,N)-diacetic acid tetrasodium salt, N-2-hydroxyethyliminodiacetic acid disodium salt, (S,S)-ethylenediaminesuccinic acid trisodium salt, methylglycinediacetic acid trisodium salt, ethylenediaminetetraacetic acid, nitorilotriacetic acid, diethylenetriaminepentaacetic acid, hydroxyethylethylenediaminetriacetic acid, triethylenetetraminehexaacetic acid, 1,3-propanediaminetetraacetic acid, 1,3-diamino-2-hydroxypropanetetraacetic acid, dihydroxyethylglycine, glycol ether diamine tetraacetic acid, hydroxyethanediphosphonic acid, aminotrimethylenephosphonic acid, 1,2,4-butanetricarboxylic acid, dihydroxyethylethylenediaminediacetic acid, sodium gluconate, sodium glucoheptonate, inositol hexaphosphate, hydroxyethanoic acid, 2-hydroxypropanoic acid, 2-hydroxysuccinic acid, 2,3-dihydroxybutanedjoic acid, and 2-hydroxy-1,2,3-propanetricarboxylic acid in an amount of 1 to 50% by mass; and a mixed solvent of water and at least one solvent selected from the group consisting of an alcohol and an ester, comprising 15 to 50% by mass of propylene glycol, relative to the whole amount of the composition;

wherein the sum total of the amounts of the surfactant component, the chelating component, and the mixed solvent including propylene glycol does not exceed 100% by mass, and wherein said composition is suitable for use as a fire-extinguishing agent.

* * * * *